US009168465B2

(12) United States Patent
Howard

(10) Patent No.: US 9,168,465 B2
(45) Date of Patent: Oct. 27, 2015

(54) SYSTEMS AND METHODS FOR ALL-SHAPE MODIFIED BUILDING BLOCK APPLICATIONS

(71) Applicant: T. Dashon Howard, Plymouth Meeting, PA (US)

(72) Inventor: T. Dashon Howard, Plymouth Meeting, PA (US)

(73) Assignee: T. Dashon Howard, Lafayette Hill, PA (US)

( * ) Notice: Subject to any disclaimer, the term of this patent is extended or adjusted under 35 U.S.C. 154(b) by 0 days.

(21) Appl. No.: 14/089,599

(22) Filed: Nov. 25, 2013

(65) Prior Publication Data

US 2015/0079871 A1 Mar. 19, 2015

Related U.S. Application Data

(63) Continuation-in-part of application No. 14/029,630, filed on Sep. 17, 2013.

(51) Int. Cl.
*A63H 33/04* (2006.01)
*A63H 33/40* (2006.01)

(52) U.S. Cl.
CPC ..... *A63H 33/046* (2013.01); *A63H 33/40* (2013.01)

(58) Field of Classification Search
USPC ..... 446/92, 102, 108, 111, 112, 122, 124, 446/125, 91; 434/211; 273/157 R; 52/578
See application file for complete search history.

(56) References Cited

U.S. PATENT DOCUMENTS

| | | | | |
|---|---|---|---|---|
| 2,688,820 | A | 9/1954 | Shemet | |
| 2,843,971 | A * | 7/1958 | Gardellin | 446/126 |
| 3,654,375 | A | 4/1972 | Geiger | |
| 3,655,201 | A * | 4/1972 | Nichols | 273/153 R |
| 3,662,486 | A * | 5/1972 | Freedman | 446/120 |
| 3,728,201 | A * | 4/1973 | Stroehmer | 428/9 |
| 3,782,029 | A * | 1/1974 | Bardot | 446/121 |

(Continued)

FOREIGN PATENT DOCUMENTS

| | | |
|---|---|---|
| BE | 898431 A1 | 6/1984 |
| CA | 2214697 A1 | 6/1998 |

(Continued)

OTHER PUBLICATIONS

"Ball of Whacks", [online]. © 1996-2013, Amazon.com, Inc. [archved on Sep. 1, 2013]. Retrieved from the Internet: <URL: https://web.archive.org/web/20130901214911/ http://www.amazon.com/Creative-Whack-BOW30-Ball-Whacks/dp/0911121013>, (2013), 5 pgs.

(Continued)

*Primary Examiner* — Kurt Fernstrom
(74) *Attorney, Agent, or Firm* — Schwegman Lundberg & Woessner, P.A.

(57) ABSTRACT

All-shape building blocks may be shaped as platonic solids. All-Shape building blocks include a flange on each tetrahedron edge, where each flange and each tetrahedron vertex may include magnetic materials (e.g., magnets, ferromagnetic metals). All-Shape building block flanges may be used to capture kinetic energy from a fluid. Multiple All-Shape building blocks may be combined to form larger structures, and the included magnetic materials may be used to retain the formed geometric structure shape.

11 Claims, 11 Drawing Sheets

(56) References Cited

U.S. PATENT DOCUMENTS

| | | | | |
|---|---|---|---|---|
| 3,785,066 | A | 1/1974 | Tuitt | |
| 4,026,087 | A * | 5/1977 | White | 52/608 |
| 4,064,662 | A * | 12/1977 | O'Toole | 52/71 |
| 4,258,479 | A * | 3/1981 | Roane | 434/211 |
| 4,492,723 | A * | 1/1985 | Chadwick, II | 428/7 |
| 4,864,796 | A * | 9/1989 | Diamond | 52/646 |
| 5,108,100 | A | 4/1992 | Essebaggers et al. | |
| 5,429,515 | A | 7/1995 | Greenwood | |
| 6,264,199 | B1 | 7/2001 | Schaedel | |
| 6,293,800 | B1 * | 9/2001 | Robertson | 434/196 |
| 6,431,936 | B1 | 8/2002 | Kiribuchi | |
| 6,443,796 | B1 | 9/2002 | Shackelford | |
| 6,524,161 | B1 | 2/2003 | Asami | |
| 6,585,553 | B1 | 7/2003 | Fetridge et al. | |
| 6,749,480 | B1 * | 6/2004 | Hunts | 446/92 |
| 6,895,722 | B1 * | 5/2005 | Ponder | 52/578 |
| 7,708,615 | B2 | 5/2010 | Munch | |
| 8,047,889 | B2 * | 11/2011 | Ishii | 446/85 |
| D660,685 | S * | 5/2012 | Bucci | D8/354 |
| 8,398,268 | B2 * | 3/2013 | Elberbaum et al. | 362/249.16 |
| 8,507,778 | B2 | 8/2013 | Olson | |
| 8,753,164 | B2 | 6/2014 | Hansen et al. | |
| 8,911,275 | B2 | 12/2014 | Maddocks et al. | |
| 2001/0021619 | A1 * | 9/2001 | Forkman | 446/129 |
| 2001/0041493 | A1 | 11/2001 | Esterle | |
| 2003/0153243 | A1 | 8/2003 | Haas | |
| 2006/0252340 | A1 | 11/2006 | Bach et al. | |
| 2007/0037469 | A1 * | 2/2007 | Yoon | 446/92 |
| 2008/0073999 | A1 | 3/2008 | Wischnewskij et al. | |
| 2009/0309302 | A1 | 12/2009 | Langin-Hooper | |
| 2011/0001394 | A1 | 1/2011 | Dalla Piazza | |
| 2011/0043079 | A1 | 2/2011 | Shirai et al. | |
| 2012/0122059 | A1 | 5/2012 | Schweikardt et al. | |
| 2013/0165012 | A1 * | 6/2013 | Klauber et al. | 446/91 |
| 2013/0217294 | A1 | 8/2013 | Karunaratne | |
| 2014/0227934 | A1 * | 8/2014 | Rudisill | 446/92 |

FOREIGN PATENT DOCUMENTS

| | | | |
|---|---|---|---|
| CN | 201643725 | U | 11/2010 |
| DE | 19617526 | A1 | 5/1997 |
| EP | 0261753 | A2 | 3/1988 |
| FR | 2114528 | A5 | 6/1972 |
| GB | 1603060 | A | 11/1981 |
| GB | 2302344 | A | 1/1997 |
| KR | 200454067 | Y1 | 6/2011 |
| WO | WO-9535142 | A1 | 12/1995 |
| WO | WO-2006040852 | A1 | 4/2006 |
| WO | WO-2008043535 | A1 | 4/2008 |

OTHER PUBLICATIONS

"Magna-Tiles Clear Colors 32 piece set", [online]. © 1996-2013, Amazon.com, Inc. [archived on Sep. 8, 2013]. Retrieved from the Internet: <http://www.amazon.com/Magna-Tiles-Clear-Colors-piece-set/dp/B000CBSNKQ/>, (2013), 5 pgs.

"Toy / Game Popular Playthings Mag-Blocks", [online]. © 1996-2014, Amazon.com, Inc. [retrieved on Apr. 28, 2014], Retrieved from the Internet: <URL: http://www.amazon.com/Game-Popular-Playthings-Mag-Blocks-Easy-To-Handle/dp/B00CGG75JA/>, (2014), 3 pgs.

"U.S. Appl. No. 14/029,630, Non Final Office Action mailed Feb. 23, 2015", 7 pgs.

"U.S. Appl. No. 14/029,630, Non Final Office Action mailed Oct. 7, 2014", 5 pgs.

"U.S. Appl. No. 14/029,630, Response filed Jan. 7, 2015 to Non Final Office Action mailed Oct. 7, 2014", 6 pgs.

"U.S. Appl. No. 14/029,630, Response filed Feb. 27, 2015 to Non Final Office Action mailed Feb. 23, 2015", 9 pgs.

"U.S. Appl. No. 14/170,372, Restriction Requirement mailed Feb. 26, 2015", 5 pgs.

"International Application Serial No. PCT/US2014/056130, International Search Report mailed Nov. 27, 2014", 5 pgs.

"International Application Serial No. PCT/US2014/056130, Written Opinion mailed Nov. 27, 2014", 5 pgs.

"International Application Serial No. PCT/US2014/067330, International Search Report mailed Feb. 17, 2015", 4 pgs.

"International Application Serial No. PCT/US2014/067330, Written Opinion mailed Feb. 17, 2015", 7 pgs.

"International Application Serial No. PCT/US2015/013766, International Search Report mailed May 11, 2015", 4 pgs.

"International Application Serial No. PCT/US2015/013766, Written Opinion mailed May 11, 2015", 5 pgs.

"U.S. Appl. No. 14/029,630, Notice of Allowance mailed May 8, 2015", 5 pgs.

"U.S. Appl. No. 14/170,372, Non Final Office Action mailed May 18, 2015", 7 pgs.

"U.S. Appl. No. 14/170,372, Response filed Apr. 23, 2015 to Restriction Requirement mailed Feb. 26, 2015", 6 pgs.

"International Application Serial No. PCT/US2015/023973, International Search Report mailed Jun. 18, 2015", 4 pgs.

"International Application Serial No. PCT/US2015/023973, Written Opinion mailed Jun. 18, 2015", 5 pgs.

* cited by examiner

SYSTEMS AND METHODS FOR ALL-SHAPE MODIFIED BUILDING BLOCK APPLICATIONS

CROSS-REFERENCE TO RELATED APPLICATIONS

The present application claims priority to and is a Continuation-in-Part of U.S. application Ser. No. 14/029,630, filed Sep. 17, 2013, which is incorporated herein by reference in its entirety.

FIELD

The present invention relates to building blocks, and specifically to magnetic educational toy blocks.

BACKGROUND

Building blocks may be assembled in various configurations to form different geometric structures. Groups of building blocks may be used as an educational toy by children, or may be used by adults or children to explore various three-dimensional shapes.

DETAILED DESCRIPTION

Building blocks may be shaped as platonic solids. All-Shape building blocks may be modified to include a flange on each tetrahedron edge, where each flange and each tetrahedron vertex may include magnetic materials (e.g., magnets, ferromagnetic metals). All-Shape building blocks may be combined to form or give the appearance of various geometric structures, and the included magnetic materials may be used to retain the formed geometric structure shape.

In the following description, reference is made to the accompanying drawings that form a part hereof, and in which is shown by way of illustration specific embodiments that may be practiced. These embodiments are described in sufficient detail to enable those skilled in the art to practice the invention, and it is to be understood that other embodiments may be utilized and that structural, logical, and electrical changes may be made without departing from the scope of the present invention. The following description of example embodiments is, therefore, not to be taken in a limited sense, and the scope of the present invention is defined by the appended claims.

Figure 1:
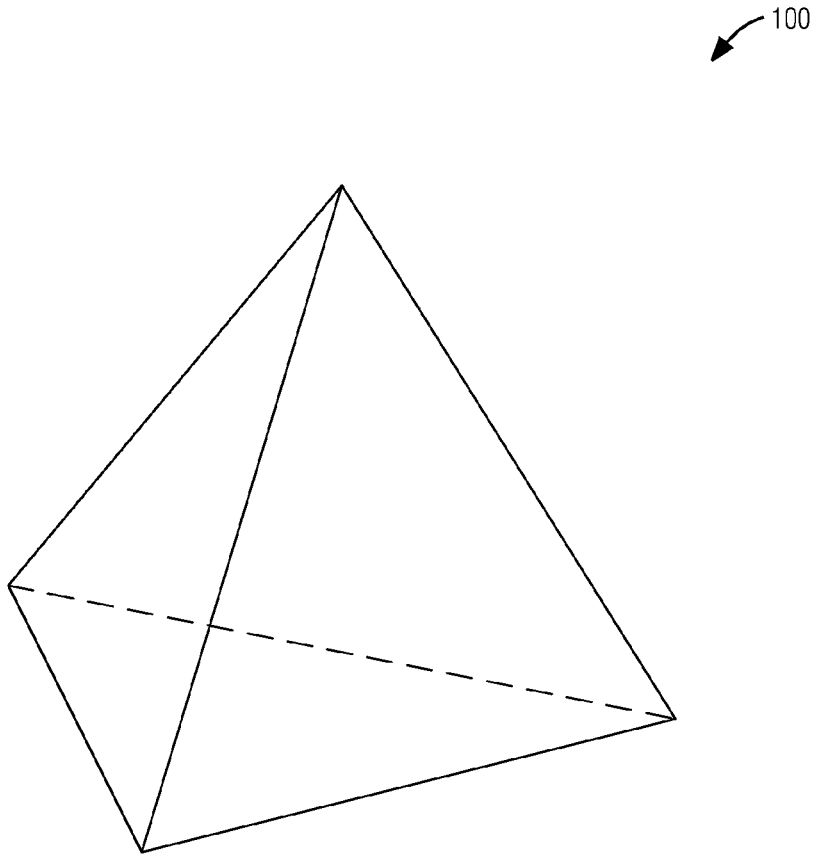
FIG. 1 is a perspective view of an All-Shape building block.

FIG. 1 is a perspective view 100 of an All-Shape building block. An example tetrahedron is formed of four triangular faces, and may be thought of as a triangular pyramid. Each tetrahedron includes four vertices, and includes six edges. Each of the triangular faces may be formed using an equilateral, isosceles, or scalene triangle, such that the triangular faces meet to form the four vertices and six edges.

Figure 2:
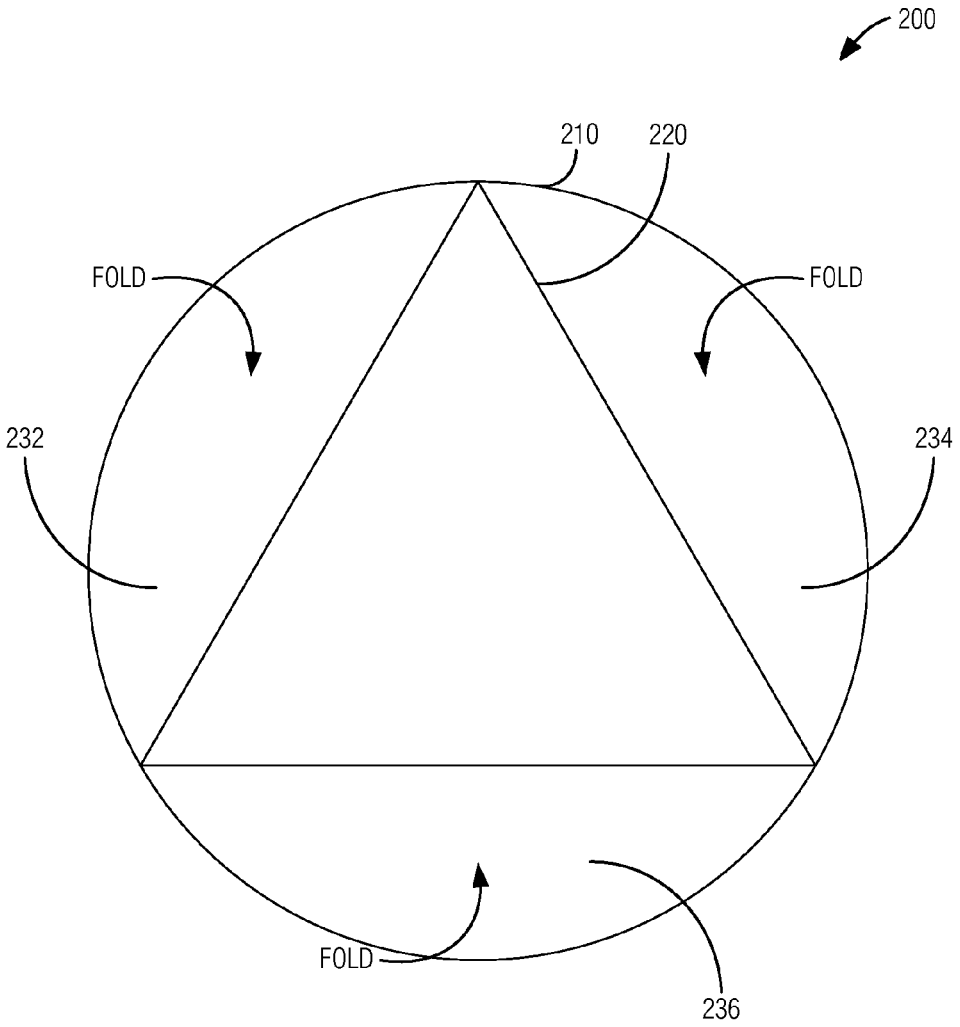
FIG. 2 is a front view of a circular face of an All-Shape building block.

FIG. 2 is a front view 200 of a circular face of an All-Shape building block. The face in FIG. 2 is shown as a circle 210, though ellipsoid or other shapes may be used. The circular face 210 may be made of a transparent material, and may be of a uniform or nonuniform thickness. The circular face 210 may include one or more photovoltaic cells, and may be used in solar power applications. For example, the cross-section of the circular face 210 may be convex or concave, and may be used as a lens in various optical applications. The circular face 210 may include various color patterns. The circular face 210 may circumscribe a triangle 220, such as a triangular face of a tetrahedron. The triangle may be comprised of three one hundred and twenty degree angles, such as in an equilateral triangle.

Various additional ornamental designs may be used on each side of the circular face 210, and may include a straight line on each side of the circumscribed triangle 220. The straight line may be a projection of the triangle edge, where two such lines at a triangle vertex form a one hundred and twenty degree angle. Various designs may include lines comprised of magnetic tape, where information may be encoded or transferred using the magnetic tape. For example, standard magnetic tape encoders and readers may be used to record or read information encoded on a magnetic tape stripe on an exterior surface. Various designs may include lines comprised of electrically conductive materials, such as copper. The circular face 210 may be constructed using a flexible material to allow the three portions of the circular face extending beyond the inscribed triangle to be folded toward the viewer to form flanges 232, 234, and 236. In another embodiment, the circular face 210 and flanges 232, 234, and 236 are constructed using a semi-flexible or inflexible material and connected at each triangle edge using a hinge, where the hinge may be constructed using a flexible material or a mechanical hinge. The flanges of four such circular faces may be connected to form an All-Shape building block, such as is shown in FIG. 3.

Figure 3:
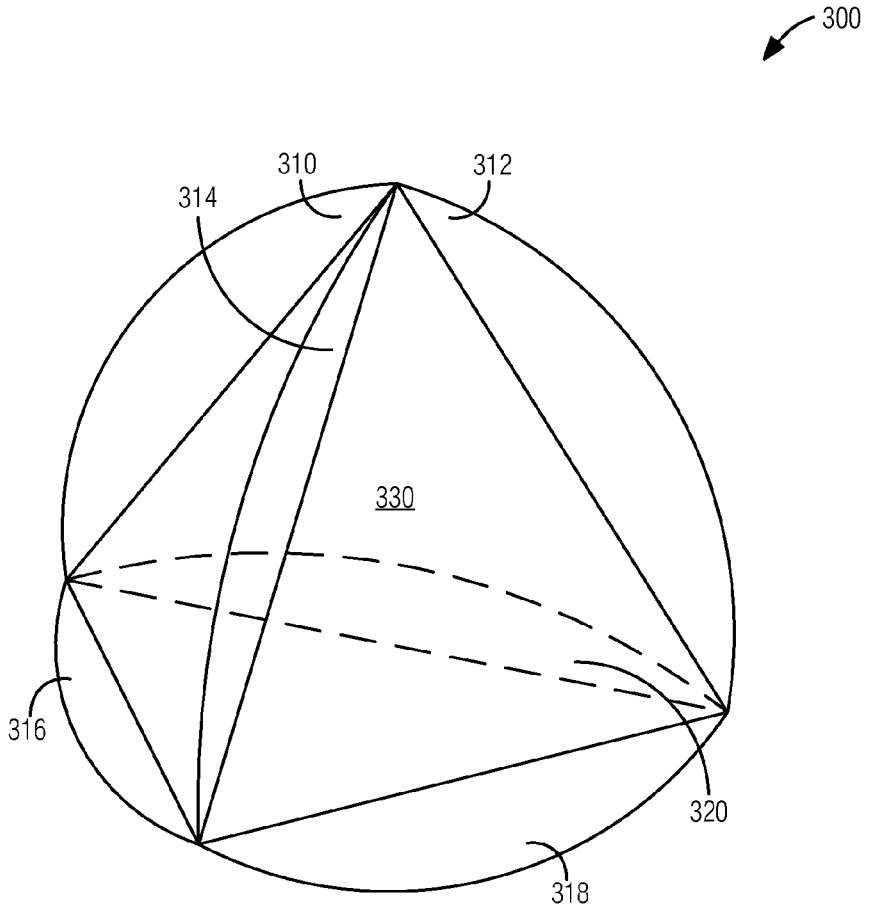
FIG. 3 is a perspective view of an All-Shape building block.

FIG. 3 is a perspective view 300 of an All-Shape building block. The All-Shape building block includes four connected circular faces. The flanges of four such circular faces may be connected to form All-Shape flanges 310, 312, 316, 318, and 320. The circular faces may be connected such that the flanges 310, 312, 316, 318, and 320 are flat, and the triangles inscribed in each of the four connected circular faces may form a tetrahedral inner space 330. In other embodiments, the circular faces may be connected at or near the circumference of each circular face such that the flanges 310, 312, 316, 318, and 320 define an inner volume (e.g., inner pocket). The outermost arcuate portions of the All-Shape flanges 310, 312, 316, 318, and 320 may define a spherical volume that corresponds with the circumscribed sphere (e.g., circumsphere) surrounding the tetrahedral inner space 330.

The All-Shape building block may be transparent, may be translucent, may include a semi-transparent material comprised of a color, or may include a solid (e.g., opaque) material. The tetrahedral inner space 330 may include one or more gasses, such as noble gasses or gasses that are translucent or colored. The tetrahedral inner space 330 may include one or more fluids (e.g., gasses or liquids). The fluid may be selected according to its response to solar heating. For example, a fluid may expand in response to solar heating and cause the flanges to open. In another example, a fluid with a high heat capacity may store energy received from solar heating, such as in concentrated solar power applications. The fluid may be selected according to its ability to change color or light absorption. For example, a suspended particle fluid may transition from a clouded appearance to a translucent appearance in the presence of an electrical voltage. Various levels of transparency or various shades of color may be used for the each side of the tetrahedral inner space 330 or for each of the All-Shape flanges 310, 312, 316, 318. The use of semi-transparent materials of various colors may allow the colors to be combined depending on orientation. For example, if the device is held so a blue face is superimposed on a yellow face, the object may appear green. Similarly, multiple All-Shape building blocks may be combined to yield various colors. Multiple All-Shape building blocks may be combined to form the appearance of various platonic solids, where the platonic solid appearance may depend on each All-Shape building block's specific periodicities of motion and wave positions in time as indicated by the direction of particular intersecting linear projections. For example, the vertices of four All-Shape building blocks using tetrahedral configurations may be combined to form a larger tetrahedron, where the larger tetrahedron maintains the one hundred and twenty degree angle at each of its vertices.

The All-Shape building block may alter its appearance based on the presence of electrical current. For example, using electrochemical materials, application of an electrical current may transition one or more surfaces of the All-Shape building block to translucent, clouded, or colored. A solid All-Shape building block may be used to conduct vibration, such as in acoustic or other applications. For example, induced mechanical vibration may be used in vibration therapy. The All-Shape building block may be constructed using a conductive material for various electrical applications. For example, one or more of the faces of the All-Shape building block may be comprised of silicon, where the silicon is arranged to function as a resistor, inductor, capacitor, microchip (e.g., integrated circuit), or other electrical component.

Figure 4:
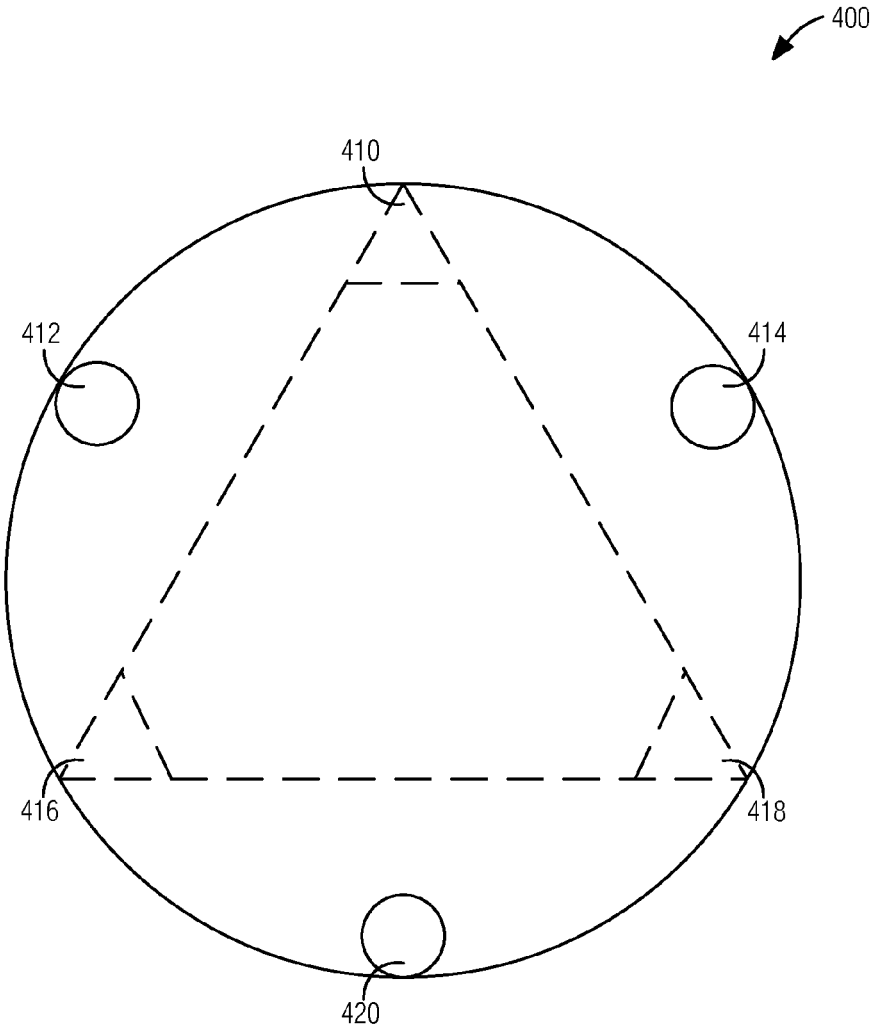
FIG. 4 is a front view of magnetic material placement within the circular face of the All-Shape building block.

FIG. 4 is a front view 400 of magnetic material placement within the circular face of the All-Shape building block. Each face may include magnetic material within each of six locations 410, 412, 416, 418, and 420. In some embodiments, each of six locations 410, 412, 416, 418, and 420 may form vacant spaces when four circular faces are connected to form an All-Shape building block. For example, flange locations 412, 414, and 420 may form disc-shaped vacant spaces, and vertex locations 410, 416, and 418 may form smaller tetrahedron-shaped vacant spaces, such as is shown in FIG. 5.

Figure 5:
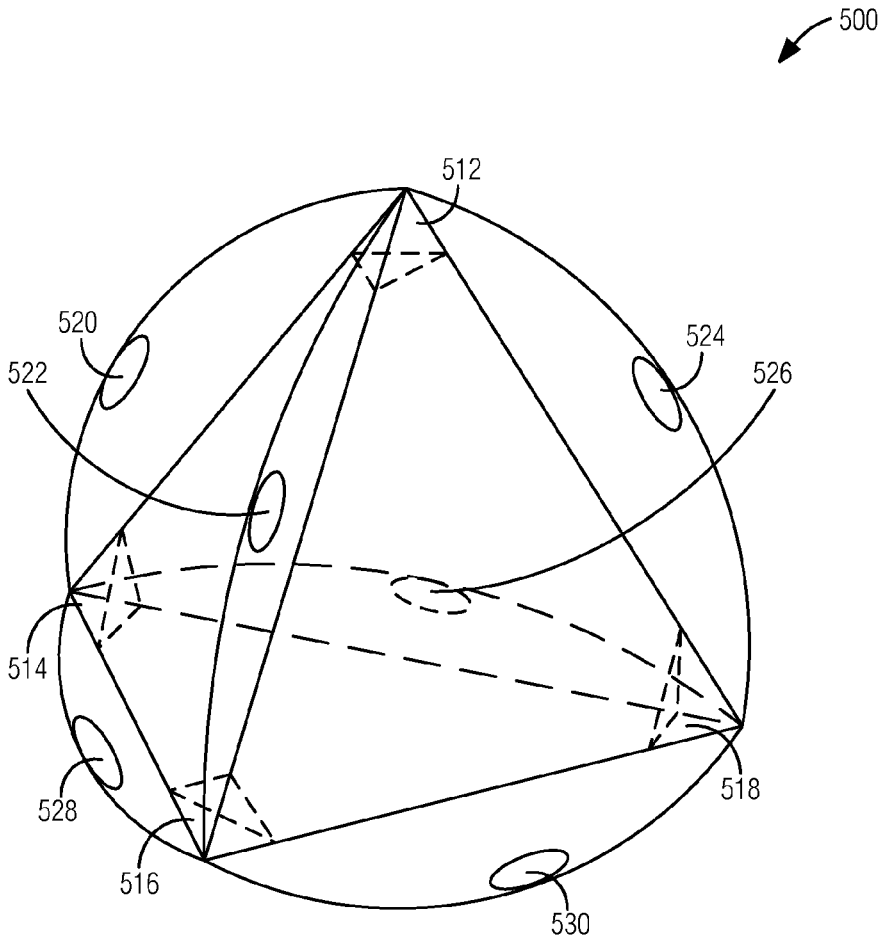
FIG. 5 is a perspective view of an All-Shape building block with magnetic materials.

FIG. 5 is a perspective view 500 of an All-Shape building block with magnetic materials. The vertices of the tetrahedron may include four tetrahedron-shaped vacant spaces 512, 514, 516, 518 for retaining magnetic material. The tetrahedron-shaped vacant spaces 512, 514, 516, 518 may retain magnetic material in a fixed position, or may allow magnetic material to shift in response to attraction or repulsion from other magnetic materials. For example, a vertex from one All-Shape building block is brought in close proximity to a vertex from another All-Shape building block, the magnets within each vertex may reorient themselves such that the vertices attract and secure the vertices to each other. Similarly, the flanges of the circular faces may include six disc-shaped vacant spaces 520, 522, 524, 526, 528, 530 for retaining magnetic material, which may retain magnetic material in a fixed position or allow magnetic material to shift in response to attraction or repulsion from other magnetic materials. The magnetic material may be used to arrange multiple All-Shape building blocks, or multiple non-magnetic blocks may be stacked, grouped in a pile, arranged on a flat surface, glued, or held together by any other means.

The combination of the four tetrahedron-shaped vacant spaces 512, 514, 516, 518 and six disc-shaped vacant spaces 520, 522, 524, 526, 528, 530 may be arranged to focus energy on a point within or external to the All-Shape building block. For example, the magnetic material may be arranged to create a positive magnetic polarity on two of the four faces of the All-Shape building block and a negative polarity on the other two faces. Similarly, when conductive material is used on or within the All-Shape building block, the magnetic material may be used to create a positive or negative polarity on a region of the All-Shape building block.

Figure 6:
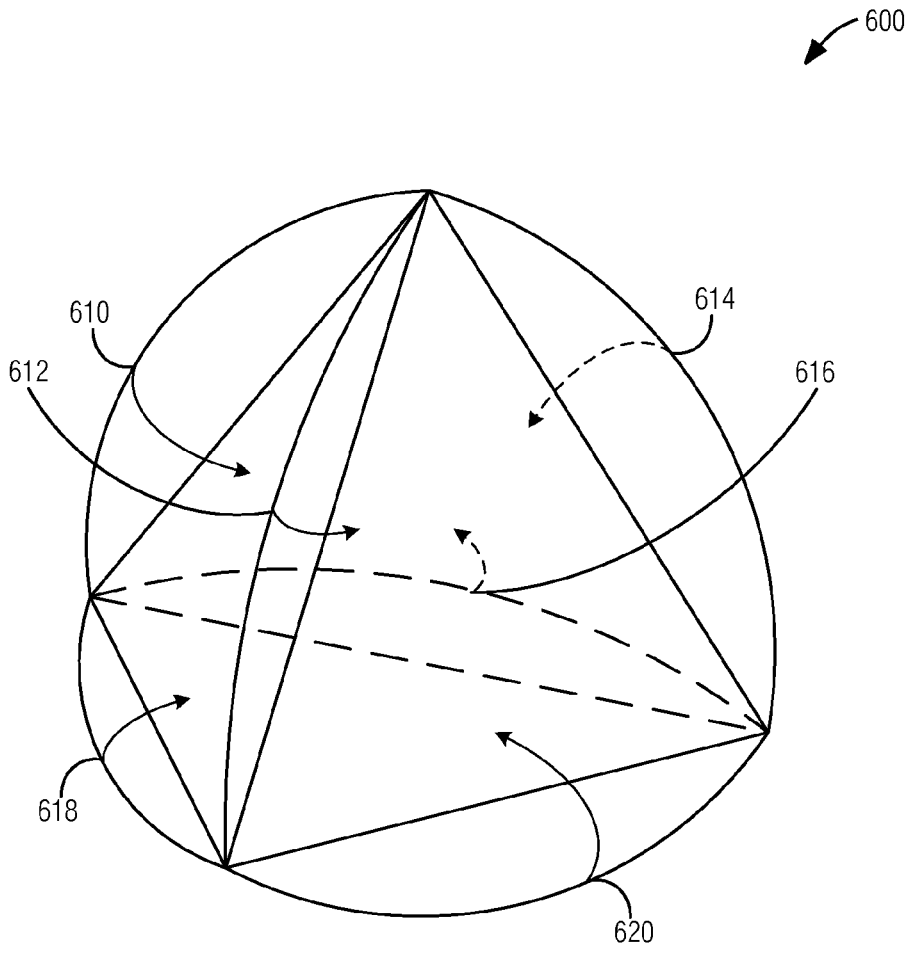
FIG. 6 is a perspective view of an All-Shape building block with flange closing directions.
Figure 8:
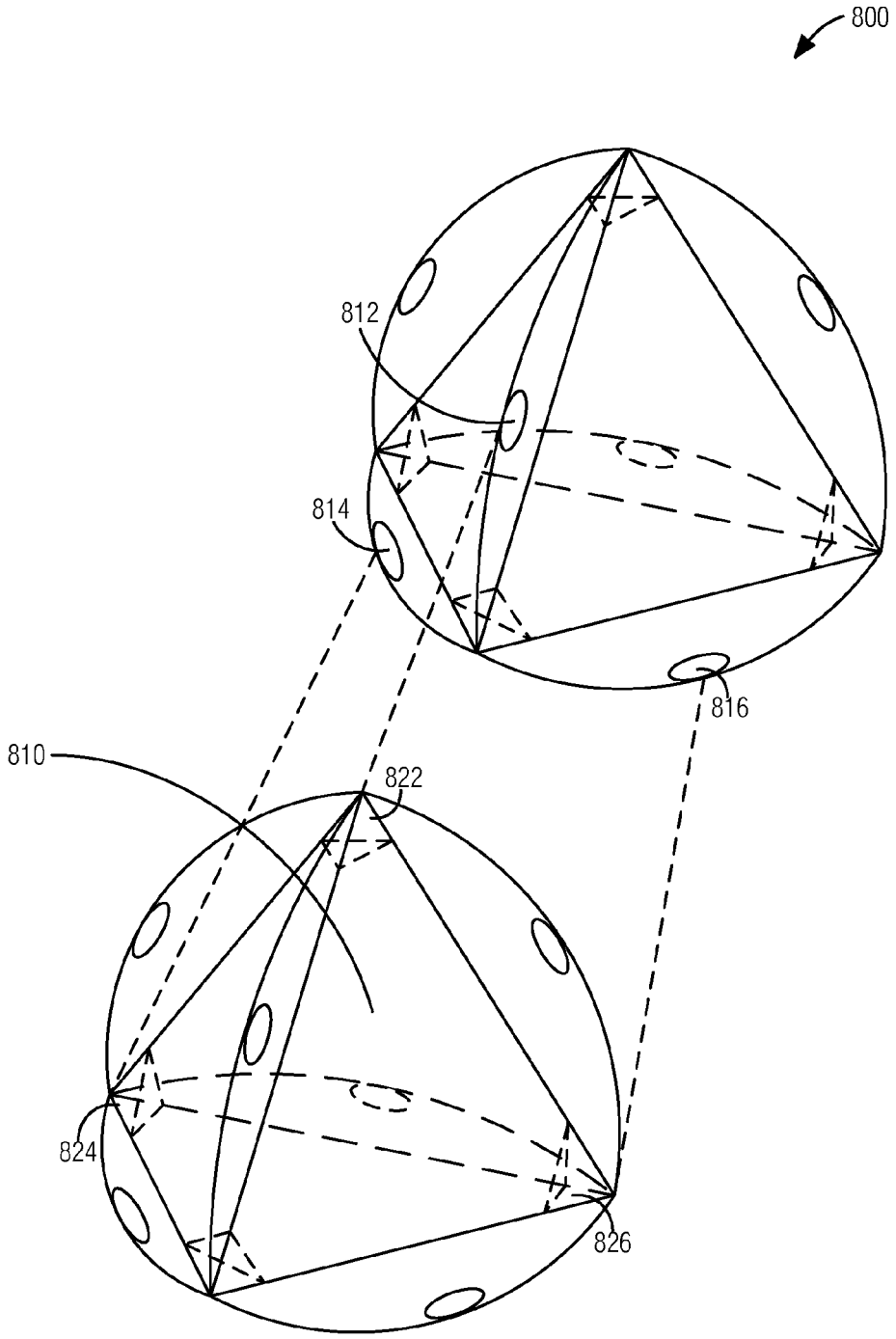
FIG. 8 is a perspective view 800 of two nested All-Shape building blocks.

FIG. 6 is a perspective view 600 of an All-Shape building block with flange closing directions 610, 612, 614, 616, 618, and 620. Each flange may be constructed using a semi-flexible or inflexible material and connected at each triangle edge using a hinge, where the hinge may be constructed using a flexible material or a mechanical hinge. The flanges may be collapsed (e.g., closed) toward the tetrahedral center of the All-Shape building block, and may become flush (e.g., coplanar) with the respective tetrahedral surfaces. The tetrahedral surfaces may also be collapsed to allow nesting (e.g., stacking) of two or more All-Shape building blocks, such as is shown in FIG. 8. The flanges may be collapsed in the directions shown in FIG. 6, or may be collapsed in a different combination of directions.

The flanges may be collapsed or opened fully or partially through various methods. The flanges may be collapsed or opened by various active mechanical or electromechanical devices. These devices may include hydraulic actuators, servos, or other mechanical or electromechanical means. For example, the flanges or inner tetrahedral surfaces may contain magnetic or electromagnetic material, and one or more electromagnets may be energized selectively to collapse or open one or more flanges. In embodiments where the flanges define an inner volume, the flanges may be collapsed or opened by heating or cooling a fluid (e.g., increasing or decreasing molecular vibration) contained within the All-Shape. For example, the fluid may be heated using solar energy, and the expanding fluid may fill the flanges and cause them to open. The flanges may be collapsed or opened by various passive methods, such as collapsing and opening opposing flanges alternatingly in response to a fluid. For example, wind may open a flange and cause the All-Shape device to rotate, and as the flange rotates into the wind, the wind may collapse that flange.

Figure 7:
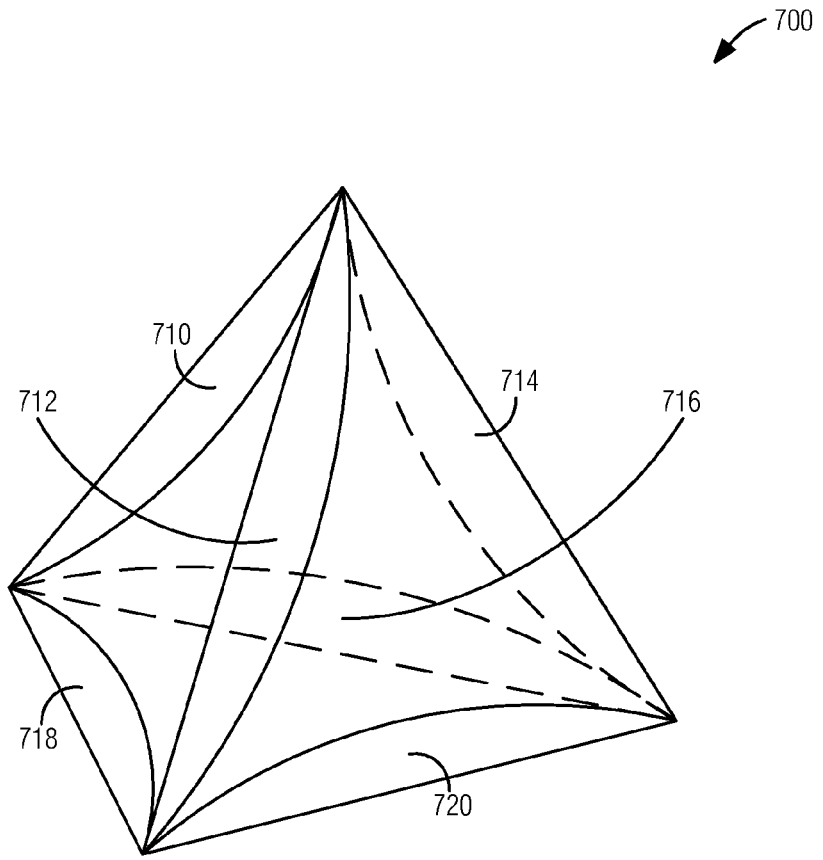
FIG. 7 is a perspective view of an All-Shape building block with closed flanges.

FIG. 7 is a perspective view 700 of an All-Shape building block with closed flanges 710, 712, 714, 716, 718, and 720. The flanges may be collapsed toward the tetrahedral center of the All-Shape building block as shown in FIG. 6. The flanges may be closed partially or completely, where a completely closed flange may be flush with the respective tetrahedral surface.

FIG. 8 is a perspective view 800 of two nested All-Shape building blocks. At least one tetrahedral surface may be collapsed or removed, such as surface 810. Two or more All-Shape building blocks may be nested, and may be connected at one or more connection points via mechanical, magnetic, or by other means. For example, magnetic flange 812 may adhere to magnetic tetrahedral inner space 822, flange 814 may adhere to space 824, and flange 816 may adhere to space 826. Multiple All-Shape devices may be nested on one or more of the four tetrahedral vertices. For example, multiple devices may be nested on the three bottom vertices to form a tripod configuration, and multiple devices may be nested on the top vertex to form a vertical column. In an additional example, a second nested tripod configuration could be arranged on the vertical column, where each of the three tripod legs serves as a counterbalance for the other two tripod legs. Any combination of nested All-Shape devices may be used to form larger structures. Nested All-Shape structures may be expanded or reinforced by adding a circular All-Shape side, such as is shown in FIG. 4. For example, a magnetic circular All-Shape side may be connected to corresponding magnets on two nested All-Shape device flanges, thereby expanding the surface area and supporting the connection between the two nested All-Shape devices. All-Shape devices may be designed asymmetrically so that a series of All-Shape building blocks may be connected to form a circle or other shape, such as is shown in FIG. 9.

Figure 9:
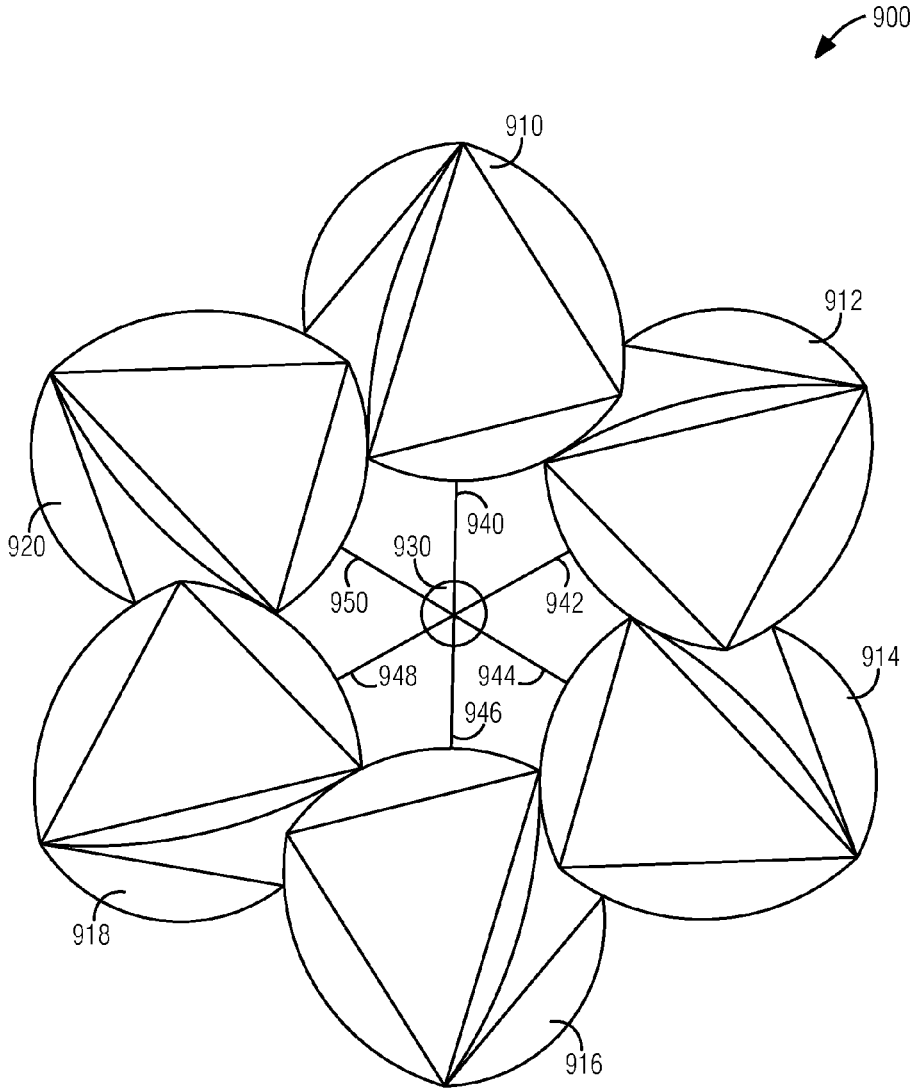
FIG. 9 is a perspective view of six connected All-Shape building blocks.

FIG. 9 is a perspective view 900 of six connected All-Shape building blocks. Six All-Shape building blocks 910, 912, 914, 916, 918, and 920 are shown, but any number of All-Shape building blocks may be connected to form a closed chain polygon (e.g., triangle, square, pentagon, etc.). The building blocks may be connected to each other by magnetic means, by soldering, or by other means. Alternatively, the building blocks may be connected to a center hub 930 using one or more spokes 940, 942, 944, 946, 948, and 950 per building block. The connected building blocks may be configured to rotate around the center hub, such as in response to a fluid flow (e.g., gas or liquid). For example, the connected building blocks may be used in a turbine configuration, where each All-Shape building block is configured to spill and catch air depending on the angles of the flanges and orientations of the All-Shape devices to cause the six connected building blocks to rotate. As another example, the connected building blocks may be used in a water wheel configuration, where water may contact flanges on the leftmost building blocks 918 and 920, and cause all connected building blocks to rotate counterclockwise. The building blocks may be adjusted to change the angular velocity, rotational direction, or other response of the connected building blocks to movement of a fluid across the surface of the All-Shape devices. Adjustments may include collapsing or opening individual flanges, or extending or retracting the respective building blocks relative to the hub. In embodiments where the building blocks are formed from or include a framework comprised of a conductive material, the connected building blocks may be arranged to form an antenna, such as for terrestrial or satellite communication. The connected building blocks may be used to conduct vibration, such as in acoustic applications, vibration therapy, or other applications. Other hydrodynamic or aerodynamic applications may be used.

Figure 10:
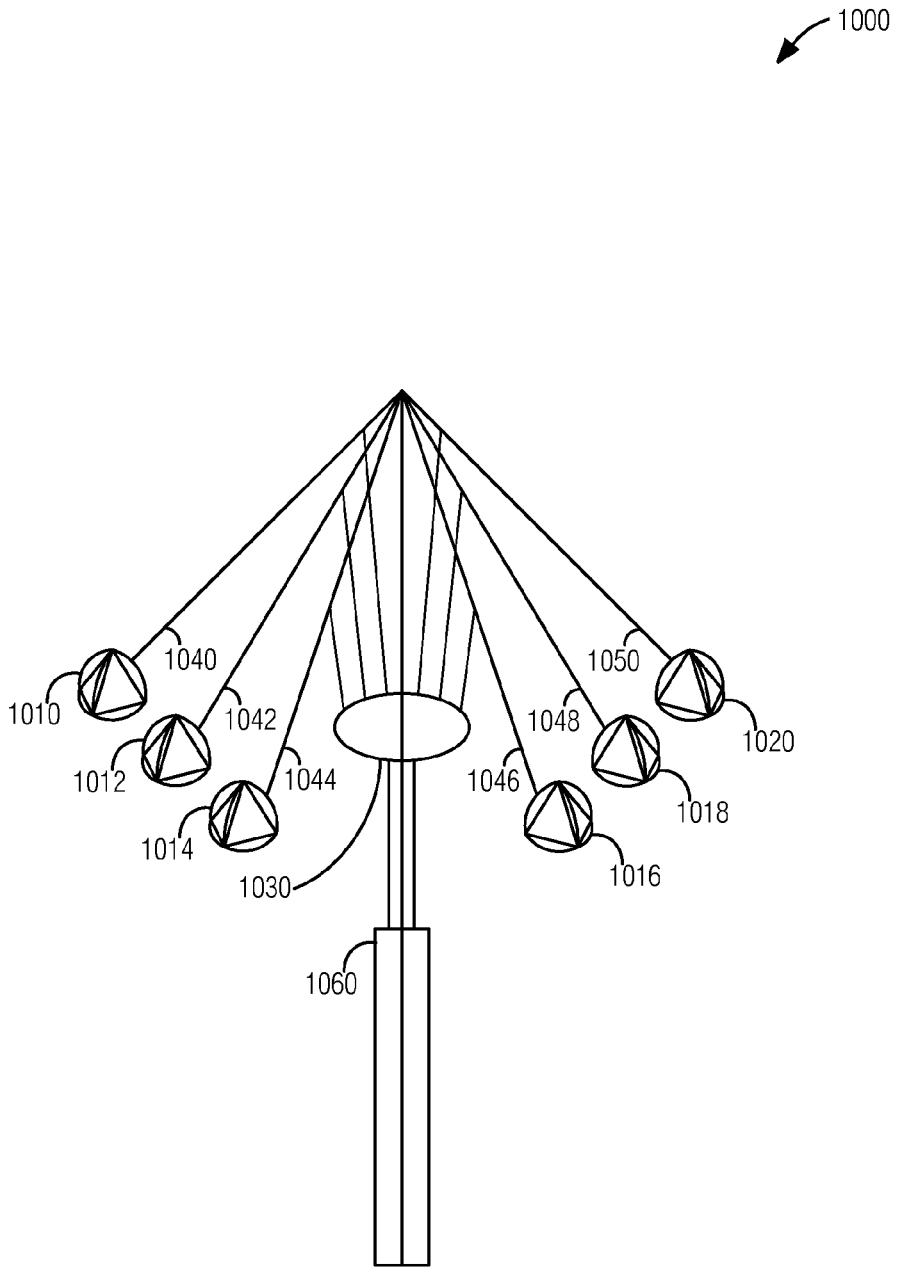
FIG. 10 is a diagrammatic view of a partially collapsed arrangement of six All-Shape building blocks.

FIG. 10 is a diagrammatic view 1000 of a partially collapsed arrangement of six All-Shape building blocks. Six All-Shape building blocks 1010, 1012, 1014, 1016, 1018, and 1020 are shown, but any number of All-Shape building blocks may be connected to form a collapsed arrangement of All-Shape building blocks. The spokes 1040, 1042, 1044, 1046, 1048, and 1050 described with respect to FIG. 9 may extend or retract in a plane perpendicular to the axis of rotation of the connected building blocks. Alternatively, the spokes may collapse toward or extended away from the axis of rotation in other directions (e.g., analogous to collapsing or deploying an umbrella), as is shown in FIG. 10. Each spoke may be extended or retracted individually, or all spokes may be connected to a central extension device 1030. An actuator 1060 may be used to move the central extension device 1030, such as a hydraulic actuator. The actuator 1060 may also be connected via hardware control lines (e.g., tension cables, pushrods, pulleys, etc.) or electronic control lines to each of the All-Shape building blocks, and may control flange positions or building block orientation. For example, the actuator 1060 may transmit a signal via an electronic control line to one or more of the All-Shape building blocks 1010, 1012, 1014, 1016, 1018, and 1020 to collapse or extend one or more flanges via electromechanical means.

Figure 11:
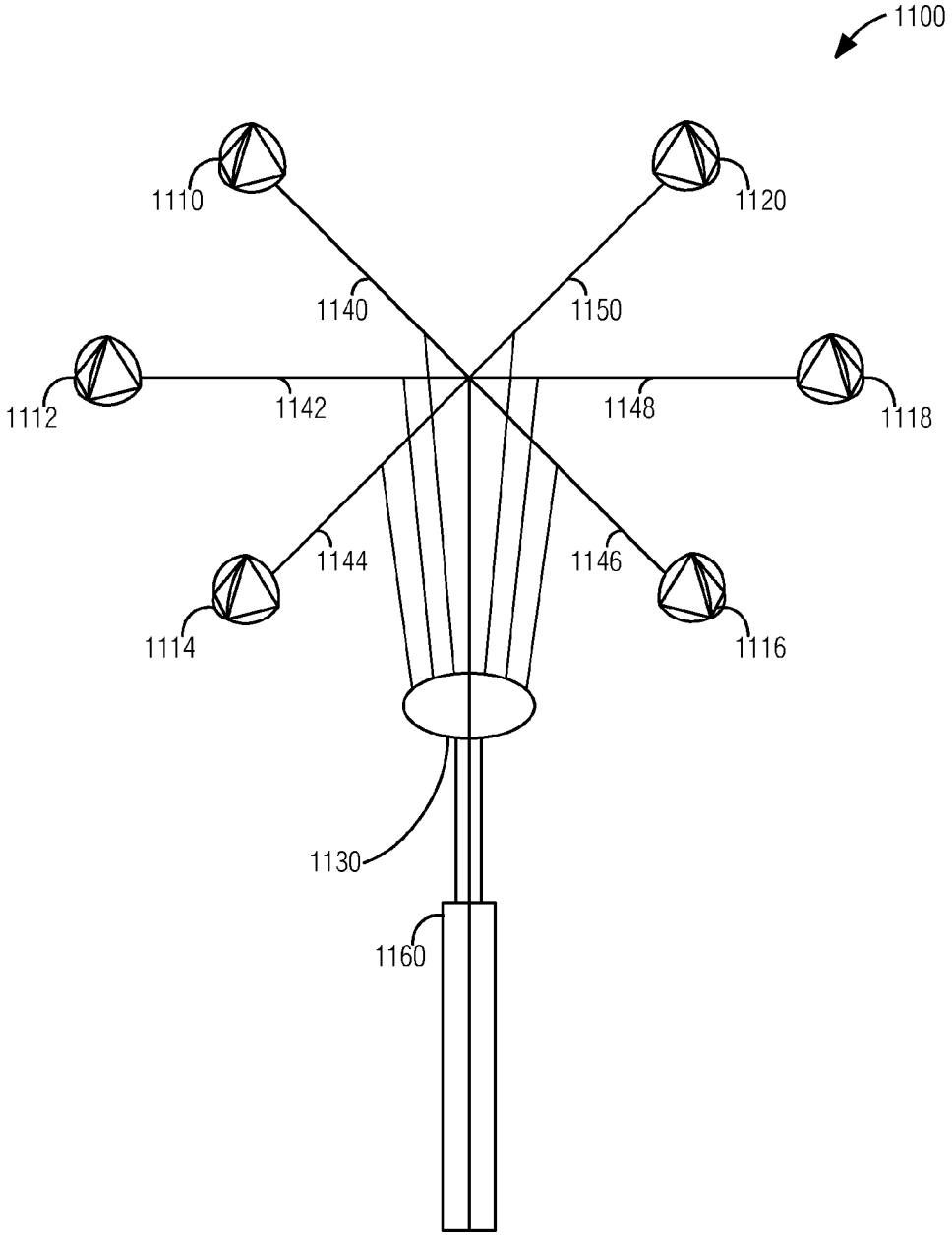
FIG. 11 is a diagrammatic view of a partially extended arrangement of six All-Shape building blocks.

FIG. 11 is a diagrammatic view 1100 of a partially extended arrangement of six All-Shape building blocks. Six All-Shape building blocks 1110, 1112, 1114, 1116, 1118, and 1120 are shown, but any number of All-Shape building blocks may be connected to form an extended arrangement of All-Shape building blocks. In contrast to the collapsed hub and spoke configuration described with respect to FIG. 9, the hub and spokes 1140, 1142, 1144, 1146, 1148, and 1150 may be extended away from the axis of rotation by using extending the central extension device 1130 with an actuator 1160.

This invention is intended to cover all changes and modifications of the example embodiments described herein that do not constitute departures from the scope of the claims.

What is claimed is:

1. A plurality of tetrahedral building blocks, each tetrahedral building block comprising:

a tetrahedron including four tetrahedral surfaces, six edges, and four vertices;

a flange disposed on each of the six edges, wherein the flanges are flexibly attached to each of the six edges, and wherein each flange is configurable to collapse toward or extend away from one of the tetrahedral surfaces; and a flange hardware control line to control a flange angle for each flange with respect to one of the tetrahedral surfaces.

2. The plurality of tetrahedral building blocks of claim 1, each tetrahedral building block further including a spoke attached to the tetrahedron, wherein the plurality of spokes are connected to a hub.

3. The plurality of tetrahedral building blocks of claim 2, wherein each spoke includes a spoke actuator configured to extend each tetrahedron away from the hub and to retract each tetrahedron toward the hub.

4. The plurality of tetrahedral building blocks of claim 2, wherein the plurality of tetrahedral building blocks are configured to rotate around the hub in response to a flow of gas or liquid.

5. The plurality of tetrahedral building blocks of claim 1, wherein at least one of the tetrahedral surfaces may be collapsed to allow nesting of a plurality of tetrahedral building blocks.

6. The plurality of tetrahedral building blocks of claim 5, further including a plurality of magnetic materials disposed within the tetrahedron or flanges, wherein the plurality of magnetic materials enable a magnetic connection among the plurality of tetrahedral building blocks.

7. A plurality of tetrahedral building blocks, each tetrahedral building block comprising:

a tetrahedron including four tetrahedral surfaces, six edges, and four vertices;

a flange disposed on each of the six edges, wherein the flanges are flexibly attached to each of the six edges; and a spoke attached to the tetrahedron, wherein the plurality of spokes are connected to a hub, wherein the plurality of tetrahedral building blocks are configured to rotate around the hub in response to a flow of gas or liquid.

8. The plurality of tetrahedral building blocks of claim 7, wherein each flange is arranged to collapse toward and extend away from one of the tetrahedral surfaces.

9. The plurality of tetrahedral building blocks of claim 8, each tetrahedral building block further including a flange hardware control line to control a flange angle for each flange with respect to one of the tetrahedral surfaces.

10. The plurality of tetrahedral building blocks of claim 7, wherein at least one of the tetrahedral surfaces may be collapsed to allow nesting of a plurality of tetrahedral building blocks.

11. The plurality of tetrahedral building blocks of claim 10, further including a plurality of magnetic materials disposed within the tetrahedron or flanges, wherein the plurality of magnetic materials enable a magnetic connection among the plurality of tetrahedral building blocks.

* * * * *